US009359754B2

(12) United States Patent
Zhou et al.

(10) Patent No.: US 9,359,754 B2
(45) Date of Patent: Jun. 7, 2016

(54) MOUNTING ASSEMBLY FOR A TOILET

(71) Applicant: Globe Union Industrial Corp., Taichung (TW)

(72) Inventors: Hongsheng Zhou, Guangdong Pr (CN); Hang You, Guangdong Pr (CN); Mingchia Wu, Taichung (TW)

(73) Assignee: Global Union Industrial Corp., Taichung (TW)

( * ) Notice: Subject to any disclaimer, the term of this patent is extended or adjusted under 35 U.S.C. 154(b) by 85 days.

(21) Appl. No.: 14/187,380

(22) Filed: Feb. 24, 2014

(65) Prior Publication Data

US 2015/0240468 A1 Aug. 27, 2015

(51) Int. Cl.
*E03D 11/00* (2006.01)
*E03D 11/16* (2006.01)

(52) U.S. Cl.
CPC ..... *E03D 11/16* (2013.01)

(58) Field of Classification Search
CPC ..... E03D 11/16; A47K 3/16
USPC ..... 4/252.1, 252.4; 285/56, 58; 248/200, 248/225.11, 220.1, 222.11, 500, 501
See application file for complete search history.

(56) References Cited

U.S. PATENT DOCUMENTS 928,523 A * 7/1909 Kelly ..... 4/252.1
5,421,036 A 6/1995 Stevens et al.
5,680,710 A * 10/1997 Carnwath ..... 33/613
6,065,160 A 5/2000 Winn
6,634,034 B2 10/2003 Rendell
8,281,421 B2 10/2012 Hughes
2015/0167284 A1 * 6/2015 Stevens

FOREIGN PATENT DOCUMENTS

DE AT 319858 B * 1/1975 ..... E03D 11/16
DE 3011228 A1 * 1/1981 ..... E03D 11/13
EP 1243710 A1 * 9/2002 ..... E03D 11/16
EP 2036475 A2 * 3/2009 ..... A47K 3/16
EP 2770128 A1 * 8/2014 ..... E03D 11/16
FR 2044243 A5 * 2/1987 ..... E03D 11/16
FR 2626915 A1 * 8/1989 ..... E03D 11/13
GB 2379256 A * 3/2003 ..... F16B 5/02
GB 2435268 A * 8/2007
WO WO 2008145820 A1 * 12/2008 ..... E03D 11/16
WO WO 2013138483 A1 * 9/2013

* cited by examiner

*Primary Examiner* — Lauren Crane
*Assistant Examiner* — Erin Deery
(74) *Attorney, Agent, or Firm* — Alan D. Kamrath; Kamrath IP Law Firm, P.A.

(57) ABSTRACT

A mounting assembly is used to fix a toilet on a toilet flange and contains two L-shaped brackets fixed on the toilet flange and each having a horizontal portion and a vertical portion. The horizontal portion has an internally raised portion, an externally raised portion, and a locating groove. The internally raised portion is retained in each arcuate slot of the toilet flange, and the locating groove is horizontally formed on the peripheral fence. The horizontal portion further has a recess for inserting an extension of the second bolt, so that the extension screws with a nut. The vertical portion has a plurality of openings defined thereon, so that the first bolt inserts into the through hole of each longitudinal fence to screw with one of the plurality of openings, such that the toilet is positioned on the toilet flange by ways of the mounting assembly.

8 Claims, 11 Drawing Sheets

MOUNTING ASSEMBLY FOR A TOILET

FIELD OF THE INVENTION

The present invention relates to a mounting assembly for a toilet.

BACKGROUND OF THE INVENTION

A conventional mounting assembly is applied to fix a toilet on a floor of a building as disclosed in U.S. Pat. No. 5,421,036, U.S. Pat. No. 6,065,160, U.S. Pat. No. 6,634,034 and U.S. Pat. No. 8,281,421.

These toilet flanges are applied on a plumbing and serve to position the toilet on a floor, and a defecation mouth of the toilet is coupled with a discharging tube of the floor. The toilet flange is comprised of a hub made of ABS or PVC material and a mounting flange made of a steel material. The hub can be made of other metal materials or plastic materials.

The toilet flange is joined with the discharging tube by using the hub, is mounted on the floor and is closed between the toilet flange and a bottom end of the toilet by ways of a wax ring. The toilet 1 has two saddles 2 formed on two sides thereof. Each saddle 2 has a fixing hole 3 as shown in FIG. 1 to insert a bolt 4 and to fix the toilet 1 on the toilet flange 5.

As shown in FIG. 2, another toilet 6 cannot be fixed on the toilet flange 5 by using a bolt. Referring further to FIGS. 3 and 4, a conventional mounting assembly for a toilet contains two L-shaped supporting members 7, with each having a horizontal extension 7*a* on which a fixing hole 7*b* is defined. A first bolt 5*a* on the toilet is inserted into the fixing hole 7*b* to screw with a nut 5*b*, thus fixing the two supporting members 7 on the two sides of the toilet flange 5. Each supporting member 7 further has a longitudinal portion 7*c* having a plurality of first orifices 7*d* relative to a respective one of two second orifices 6*b* of two longitudinal fences 6*a* of two sides of the toilet 6. As illustrated in FIG. 2, a second bolt 8 is inserted through the respective one of the two second orifices 6*b* to screw with a respective one of the plurality of first orifices 7*d*, such that the toilet 6 is fixed on the toilet flange 5 by the two supporting members 7. However, the defecation mouth of the conventional toilet offsets forwardly or backwardly, the outlet tube of the floor offsets forwardly or backwardly, and a connecting portion of the each supporting member 7 and the toilet 6 offsets forwardly or backwardly as well. Thus, the toilet 6 does not contact with the floor flatly, thereby making using the toilet feel uncomfortable and insecure.

1. Furthermore, each supporting member 7 is screwed with the toilet flange 5 by the first bolt 5*a*. Thus, a suspension portion 7*e* of each supporting member 7 bends after a long period of using time, and the toilet 6 cannot be fixed securely.

2. An inner wall 6*c* of the toilet 6 expends upwardly and outwardly, so when the second bolt 8 is screwed, the longitudinal portion 7*c* of each supporting member 7 supports a lateral locking force exerted by the second bolt 8. However, a corner of a connection area of the horizontal extension 7*a* and the longitudinal portion 7*c* is perpendicular, and the lateral locking force deforms the longitudinal portion to lower support function of each supporting member 7.

3. When the second bolt 8 is screwed tightly, each supporting member 7 supports the lateral locking force exerted by the second bolt 8 to loosen the toilet 6 easily.

The present invention has arisen to mitigate and/or obviate the afore-described disadvantages.

SUMMARY OF THE INVENTION

The primary objective of the present invention is to provide a mounting assembly for a toilet which is capable of overcoming the shortcomings of the conventional mounting assembly for a toilet.

To obtain the above objectives, a mounting assembly is used to fix a toilet on a toilet flange. The toilet includes two longitudinal fences defined on two sides thereof, and each longitudinal fence has a through hole formed thereon to insert a first bolt. The toilet flange includes a tube and a circular rim arranged around a top surface of the tube. The circular rim has at least four orifices and at least two arcuate slots. Each flange bolt is fixed on a floor of a building and is inserted into the orifice. Each arcuate slot is applied to downwardly slide and retain with a head end of a respective one of at least one second bolt. Each arcuate slot has a peripheral fence formed around an external wall thereof.

The mounting assembly contains two L-shaped brackets symmetrically fixed on two sides of the toilet flange, a horizontal portion, and a vertical portion. The horizontal portion has an internally raised portion, an externally raised portion, and a locating groove defined between the internally raised portion and the externally raised portion. The internally raised portion is retained in each arcuate slot of the toilet flange. The locating groove is horizontally formed on the peripheral fence to produce a support function. The horizontal portion further has a recess for inserting an extension of the respective one second bolt, so that the extension screws with a nut. Hence, the two L-shaped brackets are locked on the toilet flange.

The vertical portion has a plurality of openings defined thereon, so that the first bolt inserts into the through hole of each longitudinal fence to screw with one of the plurality of openings, such that the toilet is positioned on the toilet flange by ways of the mounting assembly.

Thereby the mounting assembly of the toilet has following advantages:

1. The internally raised portion and each arcuate slot are provided to facilitate each L-shaped bracket to position the toilet flange and to limit each L-shaped bracket to move along the X axis. The locating groove and the peripheral fence are arranged to limit each L-shaped bracket to move along the X axis. The side fence of the locating groove and the outer wall on the peripheral fence are applied to conduct a lateral force exerted by the first bolt toward the toilet flange, thus enhancing a lateral tolerance force of each L-shaped bracket. The externally raised portion contacts with the floor to eliminate a suspension portion of each L-shaped bracket and to increase the forward support force of each L-shaped bracket. The abutting wall of the internally raised portion and the top fence can enhance the forward support force of each L-shaped bracket. Accordingly, the toilet is locked on the toilet flange fixedly.

2. The arcuate notch is provided to facilitate a deformation of the vertical portions, so that the vertical portions contact with the toilet obliquely and tightly.

3. Each L-shaped bracket deforms, so that the side fence abuts against the outer wall to increase the forward support force of each L-shaped bracket.

4. The arcuate notch is arranged to prevent a stress force from damaging each L-shaped bracket, thus prolonging the service life of each L-shaped bracket.

DETAILED DESCRIPTION OF THE PREFERRED EMBODIMENTS

Figure 1:
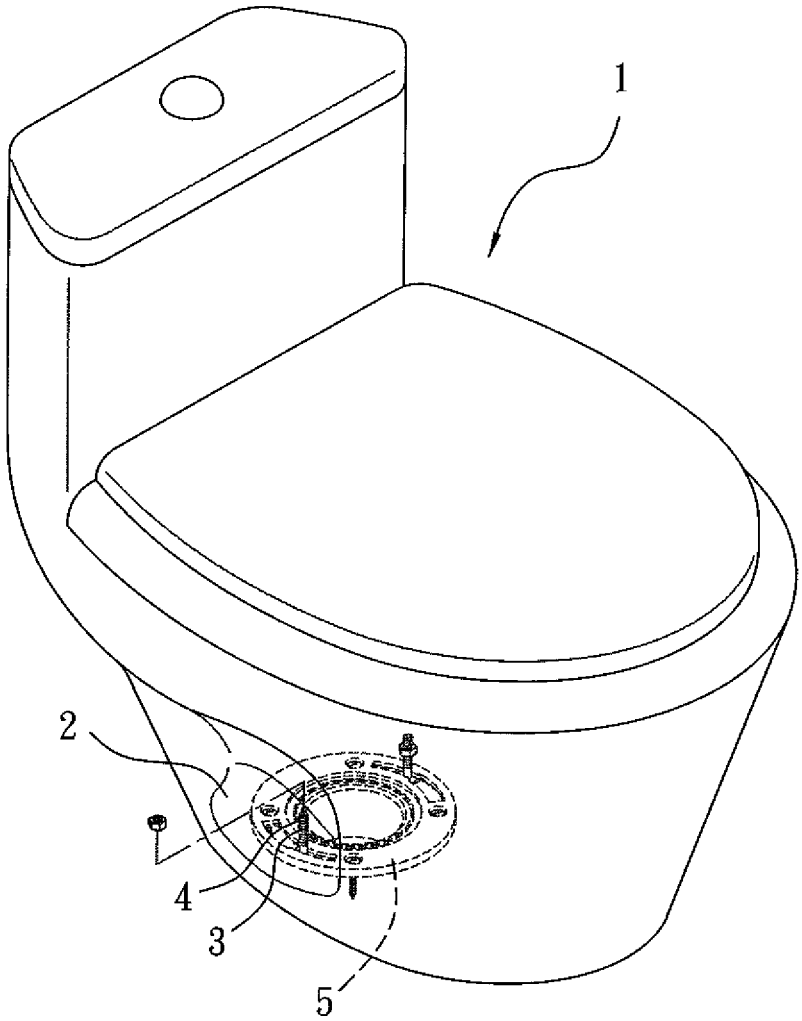
FIG. 1 Prior Art
FIG. 1 is a perspective view of a conventional toilet.
Figure 2:
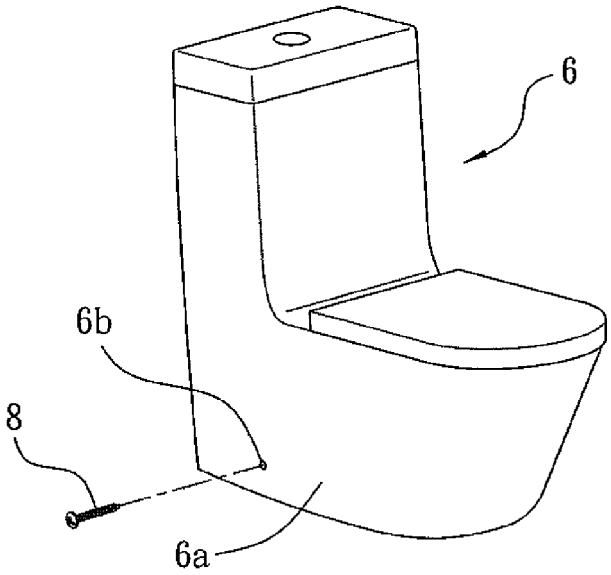
FIG. 2 Prior Art
FIG. 2 is a perspective view of another conventional toilet.
Figure 4:
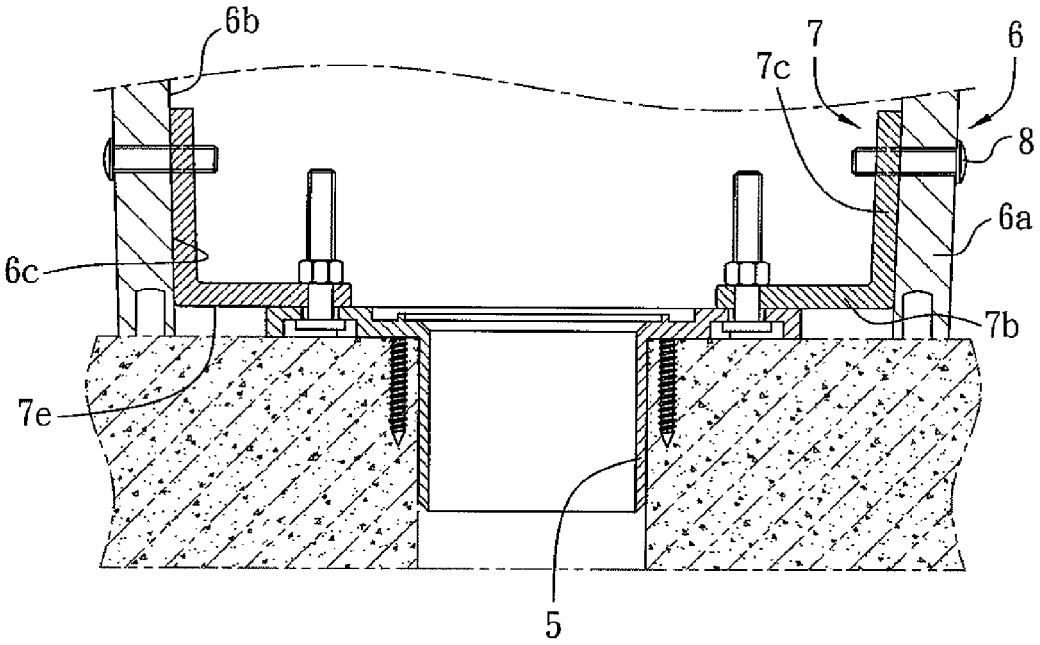
FIG. 4 Prior Art
FIG. 4 is a cross sectional view showing the assembly of the conventional mounting assembly for the conventional toilet.
Figure 3:
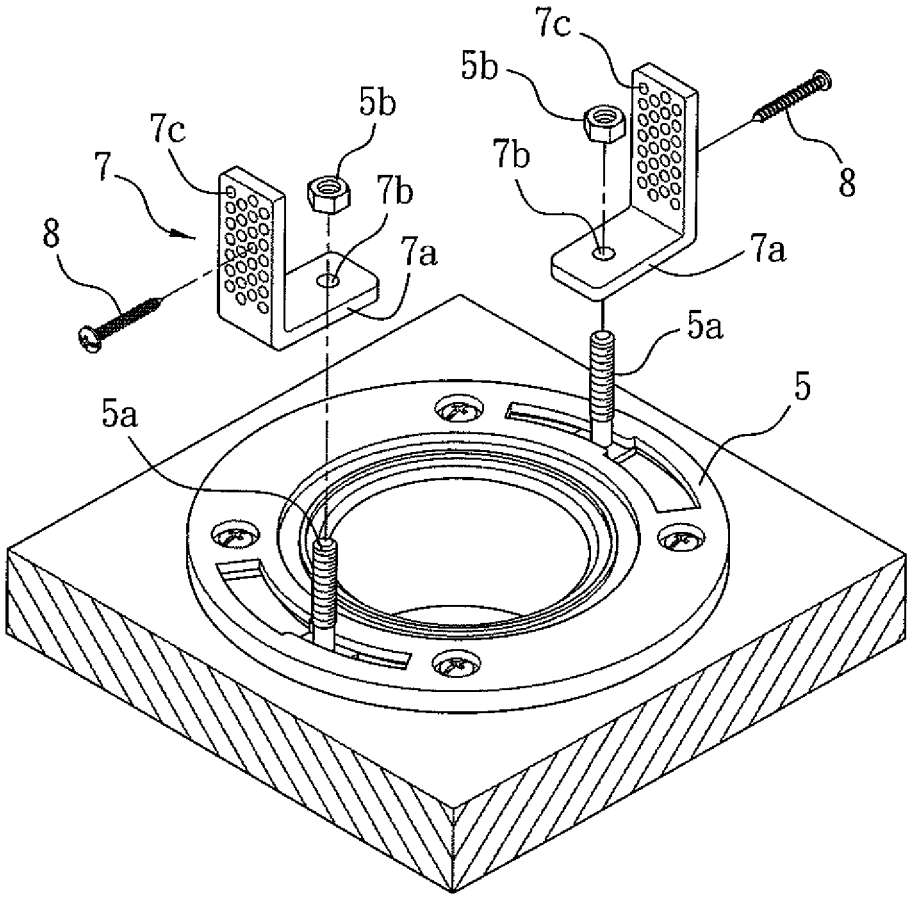
FIG. 3 Prior Art
FIG. 3 is a perspective view showing the exploded components of a conventional mounting assembly for the conventional toilet.
Figure 5:
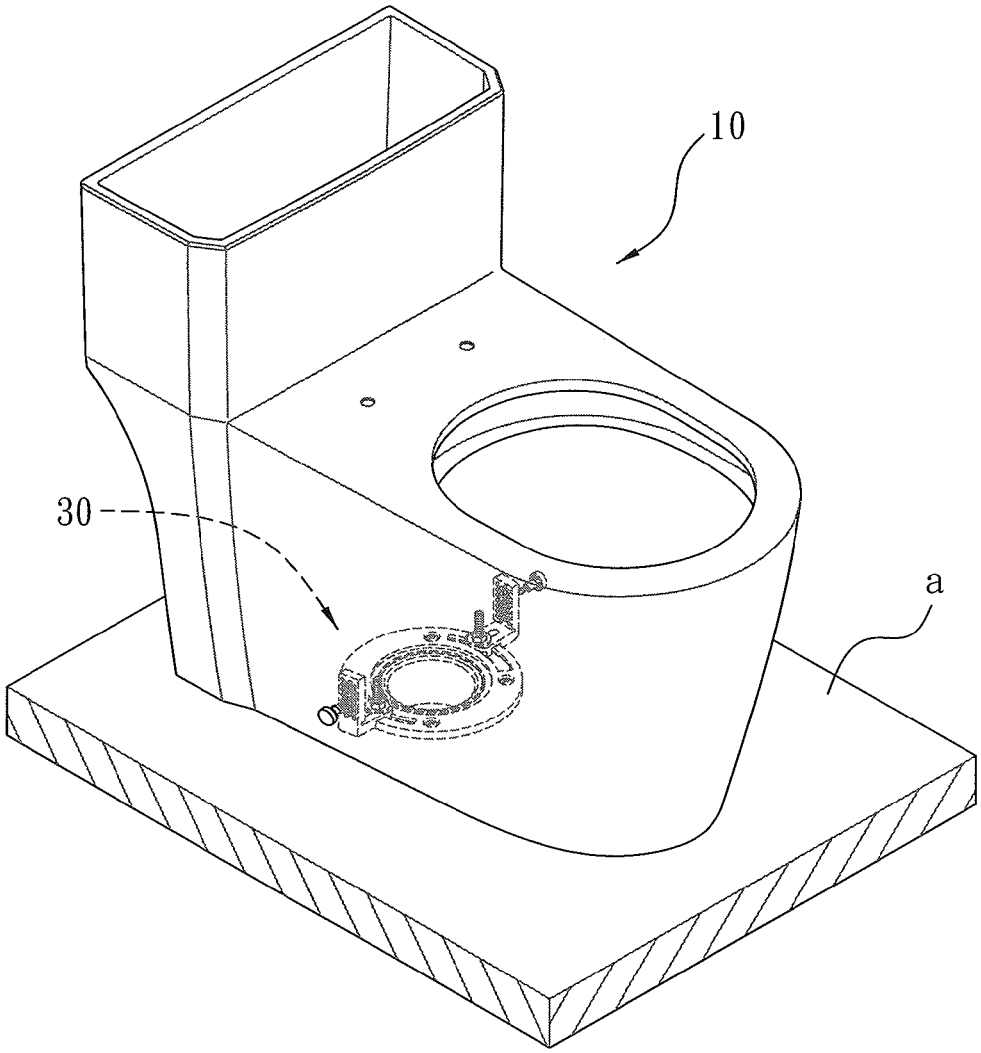
FIG. 5 is a perspective view showing a toilet fixed on a mounting assembly and a toilet flange according to a first embodiment of the present invention.
Figure 6:
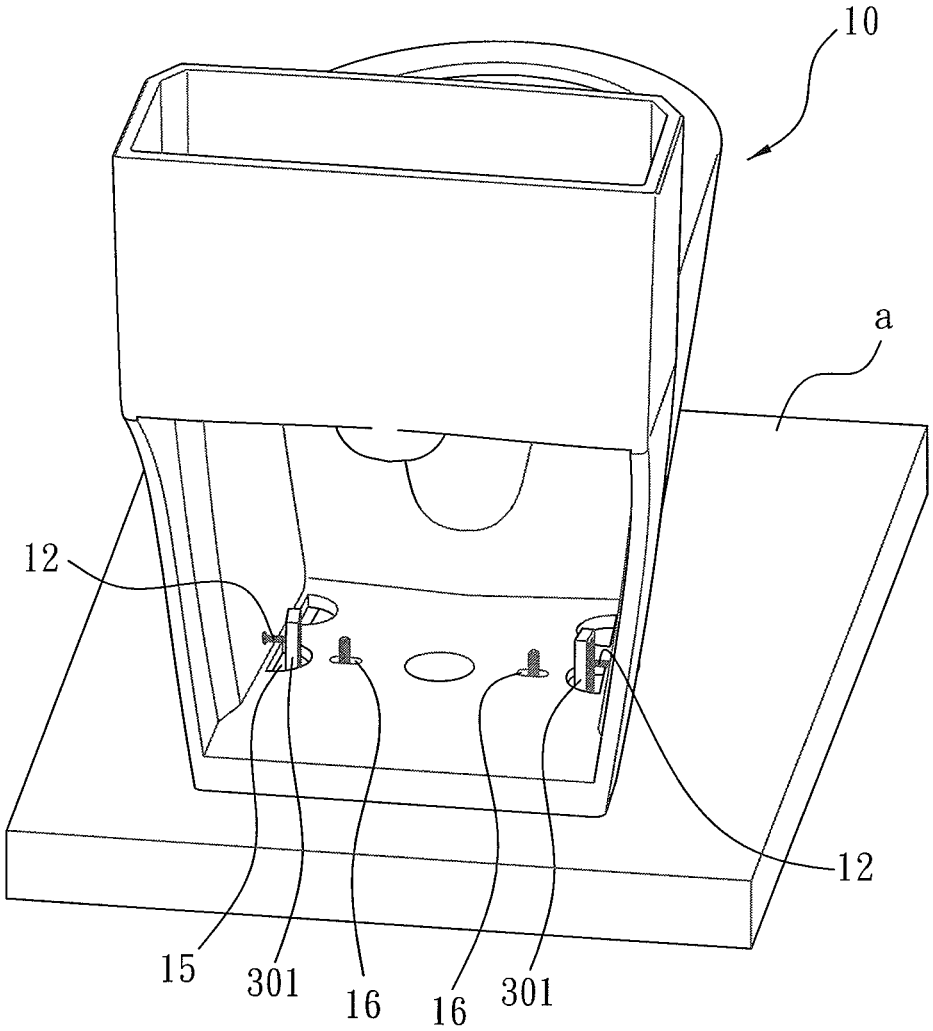
FIG. 6 is another perspective view showing the toilet fixed on the mounting assembly and the toilet flange according to the first embodiment of the present invention.
Figure 7:
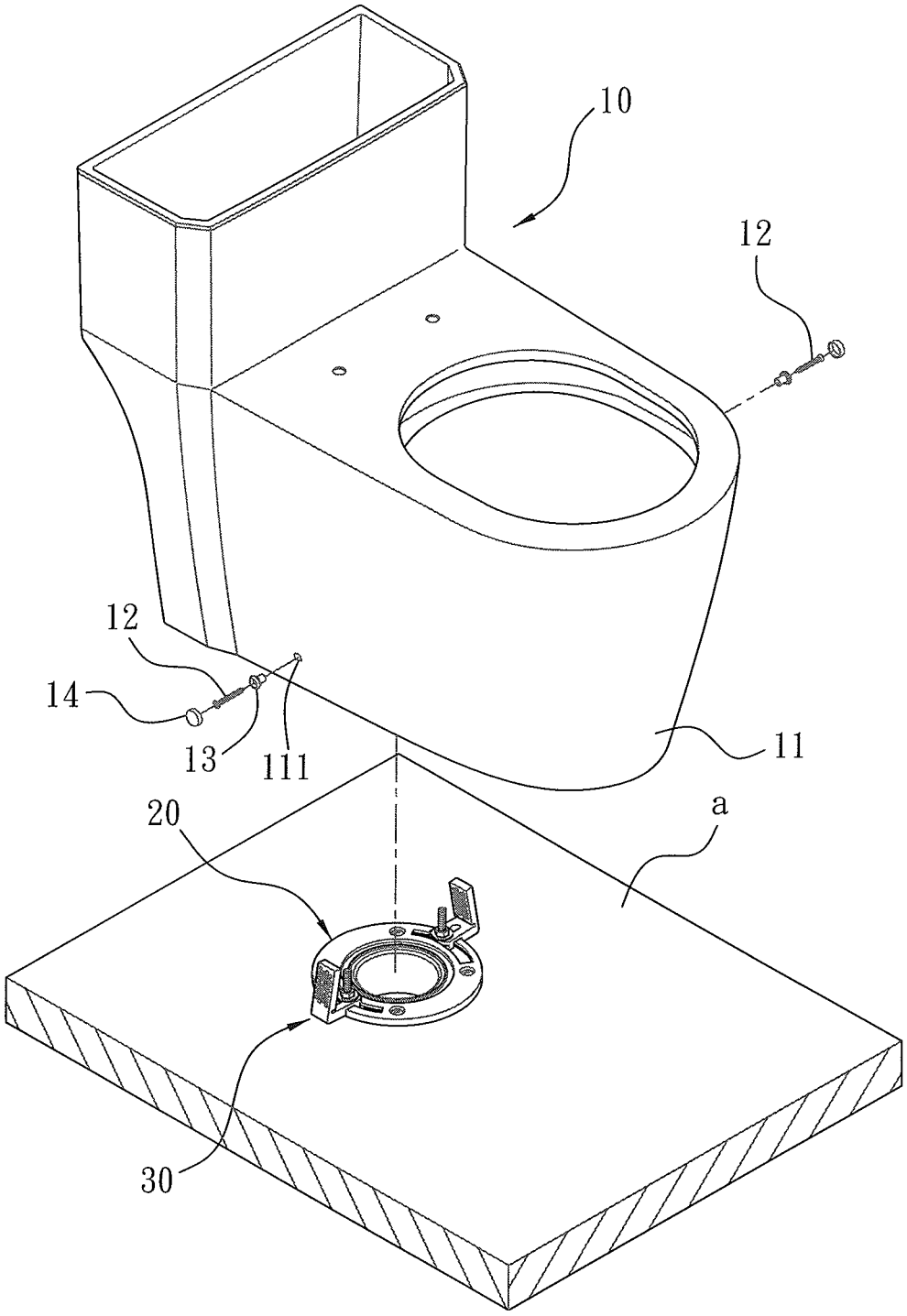
FIG. 7 is a perspective view showing the assembly of the toilet flange matching with the mounting assembly according to the first embodiment of the present invention.
Figure 8:
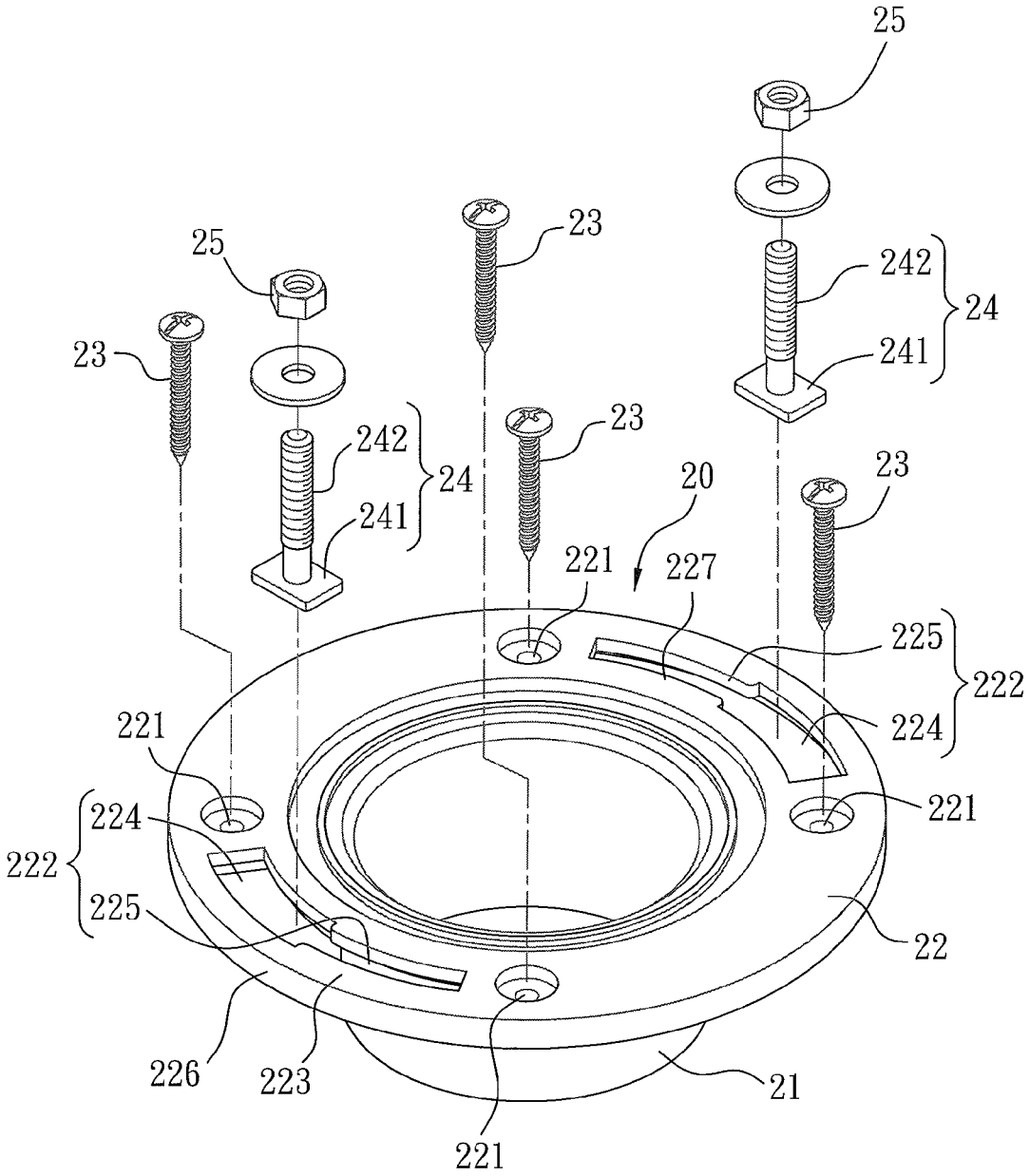
FIG. 8 is a perspective view showing the exploded components of the toilet flange according to the first embodiment of the present invention.

With reference to FIGS. 5-7, a mounting assembly according to a first embodiment of the present invention is used to fix a toilet 10 on a toilet flange 20. The toilet 10 includes two longitudinal fences 11 defined on two sides thereof, and each longitudinal fence 11 has a through hole 111 formed thereon to insert a first bolt 12. As shown in FIG. 8, the toilet flange 20 includes a tube 21 and a circular rim 22 arranged around a top surface of the tube 21. The circular rim 22 has at least four orifices 221 and at least two arcuate slots 222. A flange bolt 23 is fixed on a floor a of a building and is inserted into the orifice 221. Each arcuate slot 222 is applied to downwardly slide and retain with a head end 241 of a respective one of at least one second bolt 24, and an extension 242 of the respective one second bolt 24 extends upwardly. Each arcuate slot 222 has a peripheral fence 223 formed around an external wall thereof. In this embodiment, the circular rim 22 has four orifices 221 and two arcuate slots 222.

Referring to FIG. 8, each arcuate slot 222 has a widely slotted section 224 and a narrowly slotted section 225 communicating with the widely slotted section 224. The head end 241 of the respective one of the at least one second bolt 24 inserts through and then extends out of the narrowly slotted section 225 from the widely slotted section 224.

It is to be noted that the tube 21 and the circular rim 22 of the toilet flange 20 are one piece made of metal material or plastic material. In addition, the tube 21 and the circular rim 22 of the toilet flange 20 are two separated components and are made of the same or different metal material(s) or plastic material(s) respectively. For example, the tube 21 is made of plastic material typically, and the circular rim 22 is made of metal material. Due to the toilet flange being well-known art, further remarks are omitted.

Figure 9:
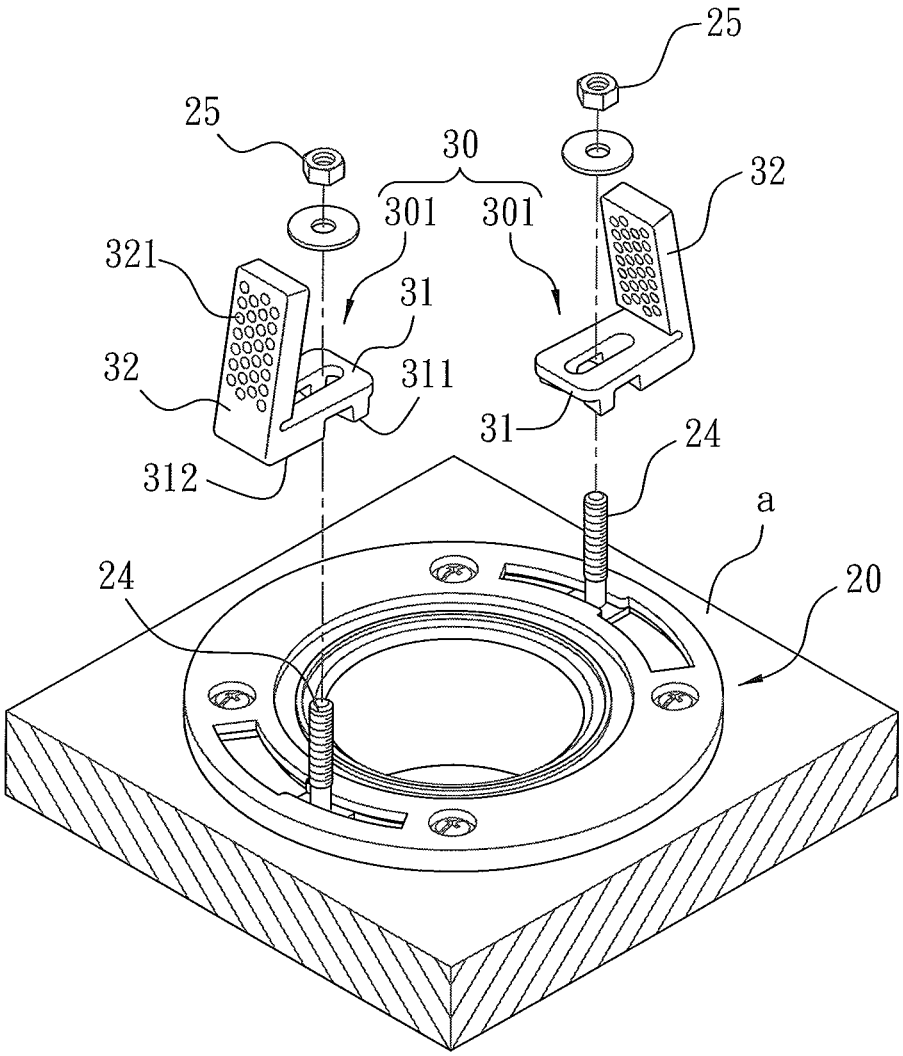
FIG. 9 is a perspective view showing the exploded components of the mounting assembly and the assembly of the toilet flange according to the first embodiment of the present invention.
Figure 10:
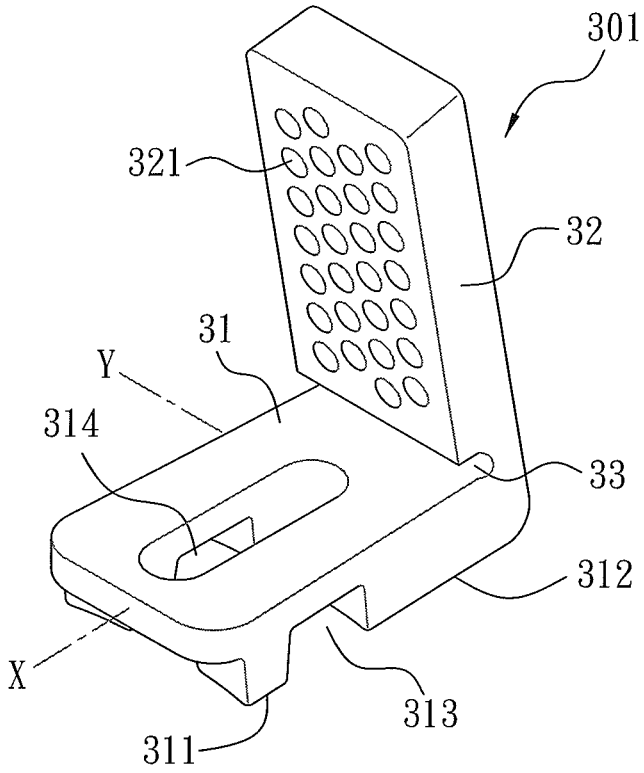
FIG. 10 is a perspective view showing the assembly of a L-shaped brackets of the mounting assembly according to the first embodiment of the present invention.
Figure 11:
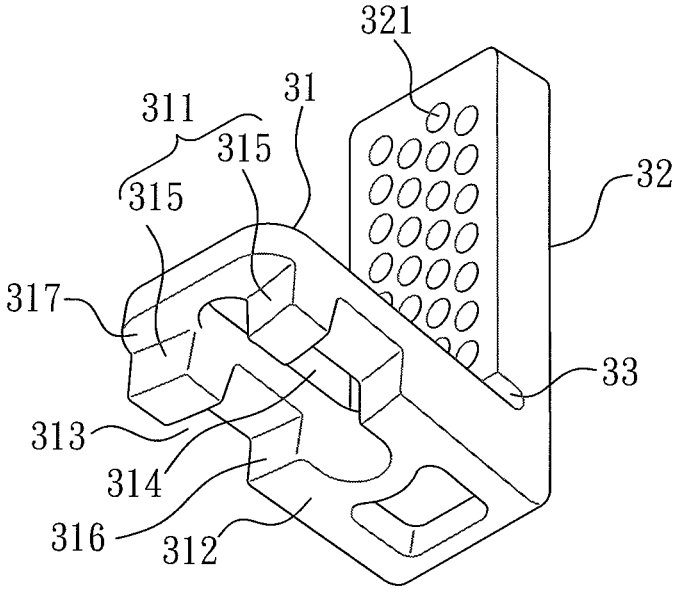
FIG. 11 is a perspective view showing the assembly of a part of the L-shaped brackets of the mounting assembly according to the first embodiment of the present invention.
Figure 12:
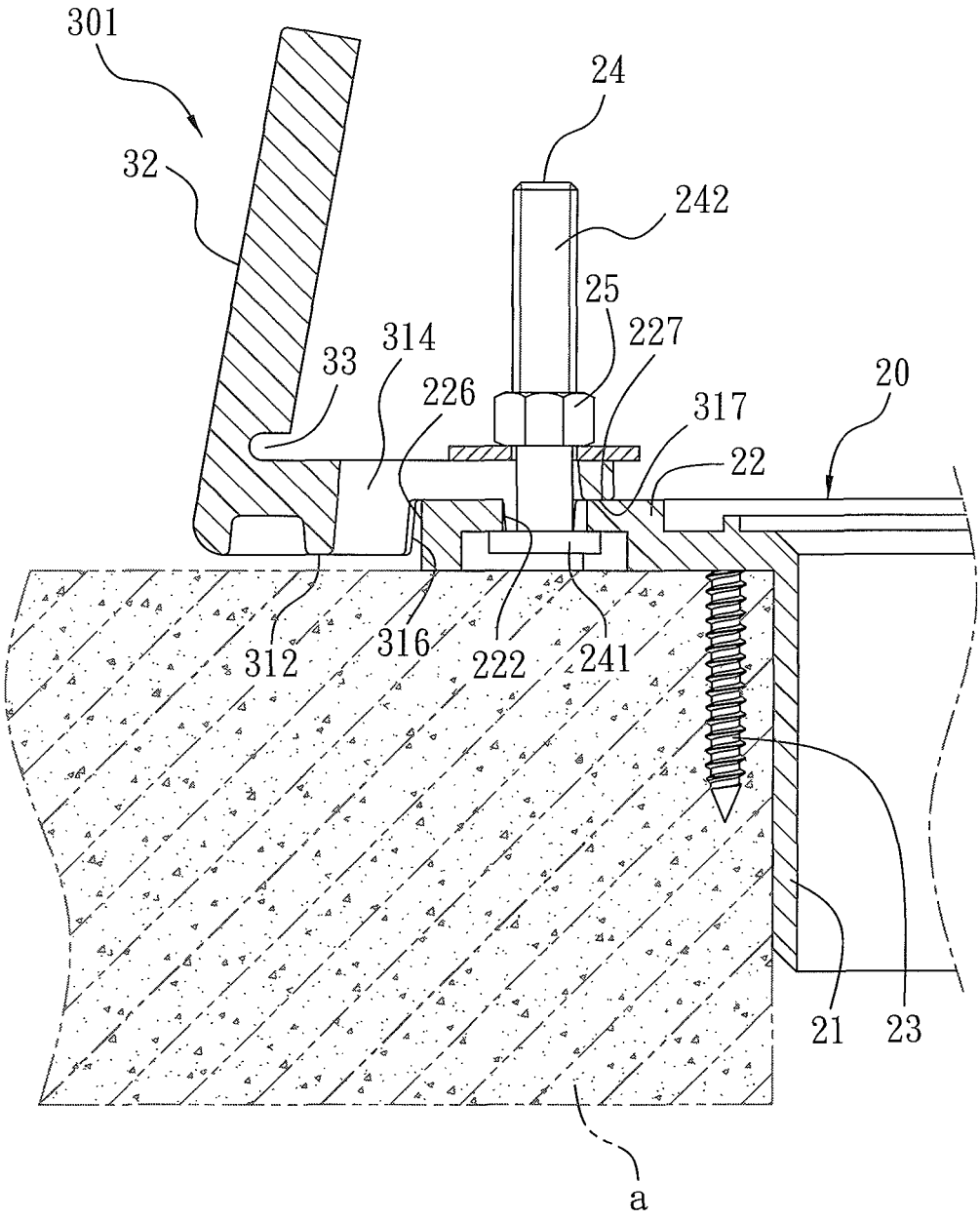
FIG. 12 is a cross sectional view showing the operation of the mounting assembly according to the first embodiment of the present invention.

As shown in FIGS. 9-11, the mounting assembly 30 comprises two L-shaped brackets 301 symmetrically fixed on two sides of the toilet flange 20, a horizontal portion 31, and a vertical portion 32. The horizontal portion 31 has an internally raised portion 311, an externally raised portion 312, and a locating groove 313 defined between the internally raised portion 311 and the externally raised portion 312. The internally raised portion 311 is retained in each arcuate slot 222 of the toilet flange 20. The locating groove 313 is horizontally formed on the peripheral fence 223 to produce a support function as illustrated in FIG. 12. The externally raised portion 312 contacts with the floor a outside the toilet flange 20 to support a forward force exerted on the two L-shaped brackets 301 or the externally raised portion 312 suspends above the floor a outside the toilet flange 20 to decrease a tolerance force. The horizontal portion 31 further has a recess 314 for inserting an extension 242 of the respective one second bolt 24, so that the extension 242 screws with a nut 25. Hence, the two L-shaped brackets 301 are locked on the toilet flange 20. In this embodiment, the recess 314 of the horizontal portion 31 is elongated and extends along an X axis.

The vertical portion 32 has a plurality of openings 321 defined thereon. The first bolt 12 inserts into the through hole 111 of each longitudinal fence 11 to screw with one of the plurality of openings 321, such that the toilet 10 is positioned on the toilet flange 20 by ways of the mounting assembly 30.

The internally raised portion 311 has two protrusions 315 formed on an inner side thereof, so that the recess 314 partially extends between two protrusions 315, and the internally raised portion 311 does not interfere with the recess 314. Hence, the internally raised portion 311 is fixed in each arcuate slot 222, and the respective one second bolt 24 is inserted through the recess 314 smoothly.

The locating groove 313 of the horizontal portion 31 has a side fence 316 opposite to the externally raised portion 312 for contacting with an outer wall 226 on the peripheral fence 223 of the toilet flange 20 as shown in FIGS. 8 and 12, thus enduring a lateral force exerted on each L-shaped bracket 301.

Figure 13:
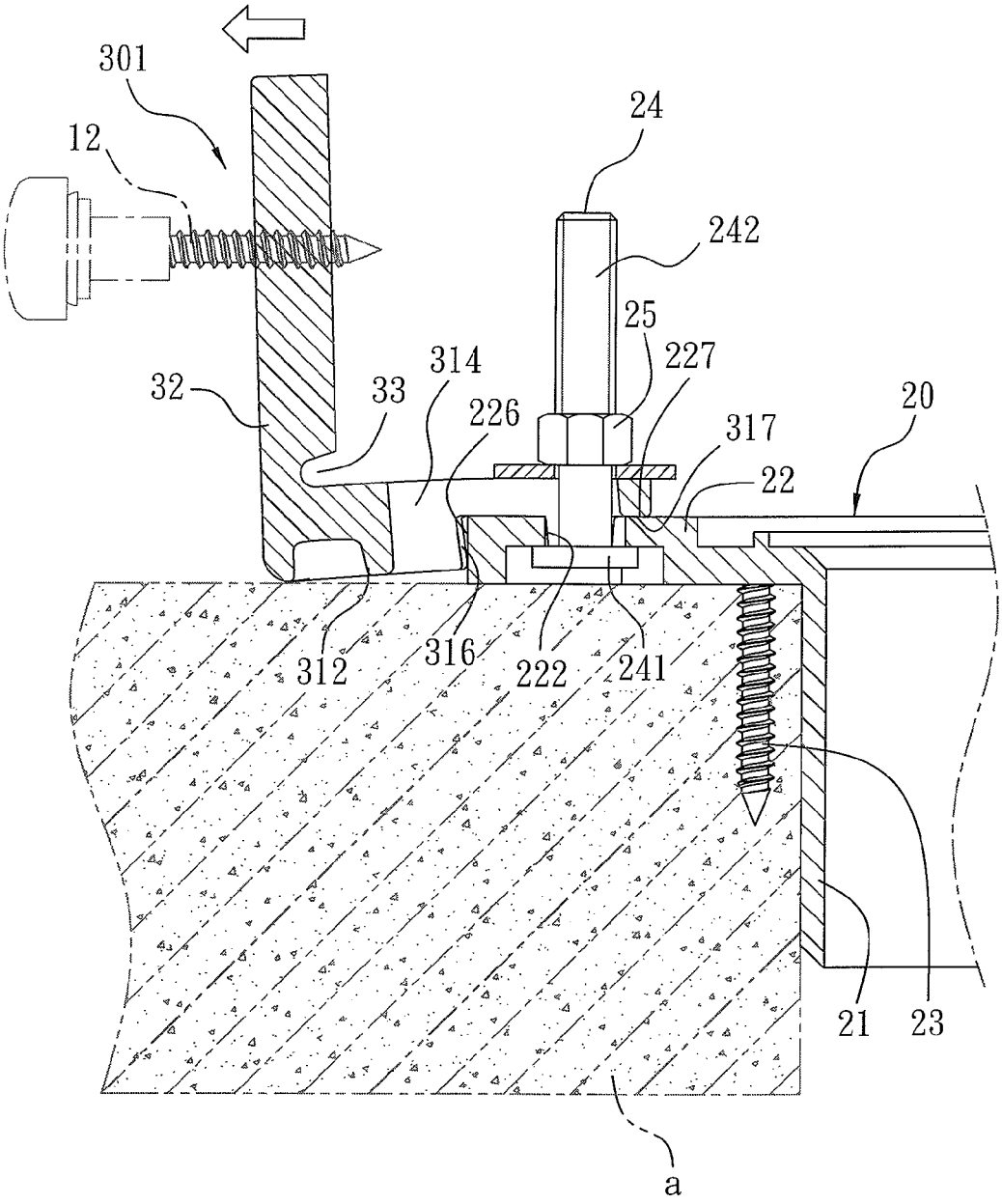
FIG. 13 is another cross sectional view showing the operation of the mounting assembly according to the first embodiment of the present invention.

As illustrated in FIGS. 12 and 13, on a connection corner of the horizontal portion 31 and the vertical portion 32 is defined an arcuate notch 33 extending along a Y axis so as to deform the vertical portion 32 flexibly when the vertical portion 32 is acted by a lateral locking force of the first bolt 12.

As illustrated in FIGS. 12 and 13, on a connection corner of the horizontal portion 31 and the vertical portion 32 is defined an arcuate notch 33 extending along a Y axis to deform the vertical portion 32 flexibly when the vertical portion 32 is acted by a lateral locking force of the first bolt 12.

The internally raised portion 311 has an abutting wall 317 formed on an inner side of thereof as shown in FIGS. 8, 11, 12 to contact with a top fence 227 of the circular rim 22 opposite to the peripheral fence 223 of the toilet flange 20, such that a contacting area between the internally raised portion 311 and the circular rim 22 is enhanced to increase a forward support force of each L-shaped bracket 301.

To enhance stability between the first bolt 12 and each longitudinal fence 11 of the toilet 10, a plug 13 is inserted onto the through hole 111 of each longitudinal fence 11 as illustrated in FIG. 7 to fix the first bolt 12. Furthermore, a sealing sleeve 14 is fitted on the plug 13 to prevent the first bolt 12 from rusting.

In assembly, the two L-shaped brackets 301 of the mounting assembly 30 are locked on the toilet flange 20 by screwing two second bolts 24 with two nuts 25 as shown in FIG. 7. Two first pores 15 of the toilet 10 align with two vertical portions 32 of the two L-shaped brackets 301, and the two second bolts 24 are fitted into two second pores 16 adjacent to two inner sides of the two first pores 15 as illustrated in FIG. 6. Thereafter, two first bolts 12 are screwed on the toilet 10. It is to be noted that when the two first bolts 12 are inserted through two through holes 111 of two longitudinal fences 11 of the toilet 10 to screw with two of a plurality of openings 321 of the two L-shaped brackets 301, the two vertical portions 32 are forced by lateral locking forces of the two first bolts 12 to deform, thus fixing the toilet 10 securely.

Thereby the mounting assembly of the toilet has the following advantages:

1. The internally raised portion 311 and each arcuate slot 222 are provided to facilitate each L-shaped bracket 301 to position the toilet flange 20 and to limit each L-shaped bracket 301 to move along the X axis. The locating groove 313 and the peripheral fence 223 are arranged to limit each L-shaped bracket 301 to move along the X axis. The side fence 316 of the locating groove 313 and the outer wall 226 on the peripheral fence 223 are applied to conduct a lateral force exerted by the first bolt 12 toward the toilet flange 20, thus enhancing a lateral tolerance force of each L-shaped bracket 301. The externally raised portion 312 contacts with the floor a to eliminate a suspension portion of each L-shaped bracket 301 and to increase the forward support force of each L-shaped bracket 301. The abutting wall 317 of the internally raised portion 311 and the top fence 227 can enhance the forward support force of each L-shaped bracket 301. Accordingly, the toilet 10 is locked on the toilet flange 20 fixedly.

2. The arcuate notch 33 is provided to facilitate a deformation of the vertical portions 32 so that the vertical portions 32 contact with the toilet 10 obliquely and tightly.

3. Each L-shaped bracket 301 deforms, so that the side fence 316 abuts against the outer wall 226 to increase the forward support force of each L-shaped bracket 301.

4. The arcuate notch 33 is arranged to prevent a stress force from damaging each L-shaped bracket 301, thus prolonging the service life of each L-shaped bracket 301.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A mounting assembly used to fix a toilet on a toilet flange, with the toilet including first and second longitudinal fences defined on opposite sides of the toilet, with each longitudinal fence having a through hole which receives a first bolt, with the toilet flange including a tube and a circular rim arranged around a top surface of the tube, with the circular rim having at least four orifices and at least two arcuate slots, with a flange bolt fixed on a floor of a building, with each arcuate slot applied to slide and retain with a head end of a second bolt, with each arcuate slot having a peripheral fence formed around an external wall of the arcuate slot; with the mounting assembly comprising first and second L-shaped brackets, with the first bracket adapted to be fixed on a first side of the toilet flange and the second bracket adapted to be fixed on a second side of the toilet flange, with the first and second brackets positioned symmetrically about the toilet flange; with each L-shaped bracket including a horizontal portion and a vertical portion; wherein each horizontal portion has an internally raised portion, an externally raised portion, and a locating groove defined between the internally raised portion and the externally raised portion; wherein each locating groove is adapted to be retained in one arcuate slot of the toilet flange and wherein the locating groove is adapted to receive the peripheral fence to produce a support function; wherein each horizontal portion has a recess adapted to receive an extension of the second bolt, wherein the first and second L-shaped brackets are adapted to be locked on the toilet flange by a nut which screws onto the extension of the second bolt;

wherein each vertical portion has a plurality of openings, with each opening adapted to screw with the first bolt inserted into the through hole of the longitudinal fence, wherein the toilet is adapted to be positioned on the toilet flange by way of the mounting assembly.

2. The mounting assembly of claim 1, wherein the internally raised portion is formed by two protrusions, and wherein the recess partially extends between the two protrusions.

3. The mounting assembly of claim 1, wherein each arcuate slot has a widely slotted section and a narrowly slotted section communicating with the widely slotted section; and wherein the head end of the second bolt is inserted into the widely slotted section and the flange slid to retain the second bolt in the narrowly slotted section such that the bolt extends out of the narrowly slotted section.

4. The mounting assembly of claim 1, wherein the locating groove of the horizontal portion has a side fence adapted to contact with an outer wall on the peripheral fence of the toilet flange to endure a lateral force exerted on each L-shaped bracket.

5. The mounting assembly of claim 1, wherein on a connection corner of the horizontal portion and the vertical portion is defined an arcuate notch extending along a Y axis to deform the vertical portion flexibly when the vertical portion is acted by a lateral locking force of the first bolt.

6. The mounting assembly of claim 1, wherein the recess of the horizontal portion is elongated and extends along an X axis.

7. The mounting assembly of claim 1, wherein the internally raised portion has an abutting wall formed on an inner side of thereof adapted to contact with a top fence of the circular rim of the toilet flange.

8. The mounting assembly of claim 1, wherein the externally raised portion is adapted to contact with the floor outside the toilet flange to support a forward force exerted on the first and second L-shaped brackets.

* * * * *